US012434094B2

(12) United States Patent
Jones

(10) Patent No.: US 12,434,094 B2
(45) Date of Patent: Oct. 7, 2025

(54) SINGLE-LEG RDL MACHINE

(71) Applicant: John Gregory Jones, Miami, FL (US)

(72) Inventor: John Gregory Jones, Miami, FL (US)

(73) Assignee: John Gregory Jones, Miami, FL (US)

( * ) Notice: Subject to any disclaimer, the term of this patent is extended or adjusted under 35 U.S.C. 154(b) by 94 days.

(21) Appl. No.: 18/604,483

(22) Filed: Mar. 13, 2024

(65) Prior Publication Data

US 2025/0288867 A1 Sep. 18, 2025

(51) Int. Cl.

*A63B 23/035* (2006.01)
*A63B 21/00* (2006.01)
*A63B 23/04* (2006.01)

(52) U.S. Cl.

CPC .... *A63B 23/03508* (2013.01); *A63B 21/4034* (2015.10); *A63B 21/4047* (2015.10); *A63B 23/0482* (2013.01); *A63B 2225/093* (2013.01)

(58) Field of Classification Search

CPC ..... A63B 23/0222; A63B 23/3508; A63B 23/0482; A63B 21/00178; A63B 21/002; A63B 21/04; A63B 21/065; A63B 21/068; A63B 21/4009; A63B 69/0057; A63B 69/0059; A63B 69/0062

See application file for complete search history.

(56) References Cited

U.S. PATENT DOCUMENTS 3,215,438 A * 11/1965 Sheldon ..... A63B 69/0057 473/277
4,948,142 A * 8/1990 Taber ..... A63B 69/3608 473/275
6,575,844 B1 * 6/2003 Gray ..... A63B 69/0057 473/277
6,843,730 B1 * 1/2005 Bellagamba ..... A63B 69/0057 473/215
6,988,957 B2 * 1/2006 Bender ..... A63B 69/3621 473/277
7,591,734 B2 * 9/2009 Mazzone ..... A63B 69/0057 473/277

(Continued)

*Primary Examiner* — Zachary T Moore

(57) ABSTRACT

The Single-Leg Romanian Deadlift (Single-Leg RDL) machine is an exercise training invention which is used to stabilize a person's body while they carry out the Single-Leg RDL exercise. It enhances lateral stabilization while leaving the hips and torso free enough to execute the Single-Leg RDL exercise. Secondly, it optimizes recruitment of the hip extensor muscles by providing better stabilization of the "exercise target leg" along the sagittal plane. The former is accomplished by way of the apparatus providing the user's hip opposite the exercise target leg with a rotating hip stabilizing-pivot joint structure, that moves along the sagittal plane with the user so as to follow the changing angle of the user's hip as the user carries out the Single-Leg RDL. The latter is accomplished by the apparatus rigid frame which sturdily supports sagittal plane forces without tipping over and by way of lower leg supporting pads that anchor the user's exercise target leg thereby allowing the user to get optimal eccentric phase movement with minimal technique and balance demands. The apparatus also enables both hands to be free which results in heavier weight loading capacity and equal distribution on the low back muscles during the exercise.

1 Claim, 4 Drawing Sheets

(56) References Cited

U.S. PATENT DOCUMENTS

| | | | | |
|---|---|---|---|---|
| 8,784,229 | B1 * | 7/2014 | McCullough ..... | A63B 69/3676<br>473/266 |
| 10,252,131 | B2 * | 4/2019 | May, II ..... | A63B 69/0057 |
| 11,167,195 | B2 * | 11/2021 | Bridgewater ..... | A63B 69/3676 |
| 2007/0232406 | A1 * | 10/2007 | Grant ..... | A63B 69/0059<br>473/257 |

* cited by examiner

SINGLE-LEG RDL MACHINE

CROSS-REFERENCE TO RELATED APPLICATIONS

This application claims the benefit of U.S. Provisional Patent Application No. 63/451,927, filed Mar. 14, 2023, which is incorporated by reference herein in its entirety.

BACKGROUND OF THE INVENTION

My invention pertains to the fields of endeavor of exercise science, strength & conditioning, sports performance training, sprint training, running speed training, athletic training, physical therapy, and physical rehabilitation.

The Single-Leg RDL apparatus invention mitigates the common adverse misalignment issues that inherently arise from the namesake unilateral exercise all the while enhancing the ability to isolate the agonist muscle groups (glute maximus and hamstrings muscles) involved and providing more option for further weight loading. The former is of primary benefit as it can assist in injury prevention and the latter is of primary benefit when applying the principle of exercise training known as "progressive overload" which deals with the required progressive mechanical loading of muscle needed to induce further strength and hypertrophy training adaptations over time. The Single-Leg RDL is an effective popular "closed-chain hip extension" exercise for various athletes and people in the general population with muscle-strength, physique, and/or other health/fitness goals.

A specific problem involved in the prior art that my invention is drawn to is that, to my knowledge, there is no apparatus that allows for attenuation/removal of the misalignment issues inherent to the Single Leg RDL, increases the opportunity for weight loading, and which prevents the uneven rotational loading that occurs on the lower back. There are adaptations to the traditional Single-Leg RDL that attempt to address some of these Single-Leg RDL misalignment and stability shortcomings. One example of this is the Single-Leg RDL "kickstand variation" in which a person standing up uses the non-target leg as a "kickstand" behind them so as to support some lateral weight distribution but yet not entirely assist the target leg being trained. Another variation of the Single-Leg RDL that's used to address misalignment and stability issues involves placing the knee of the non-target side on a bench. Although both variations help provide some additional lateral stability, in both cases that comes at the expense of no longer having a true unilateral exercise due to the decreased relative resistance on the target side which is caused by the kickstand/stability leg needing to be somewhat engaged in order to provide the added stability. Although inadvertent, this inevitably lessens the relative load on the target side significantly. My invention addresses this by allowing for lateral support that does not decrease the exercise target side's relative resistance/load. A third Single-Leg RDL variation that assists with stability and misalignment involves using one hand against a fixed object. Although this approach doesn't reduce the relative load of the target muscles and helps with misalignment/stability, it doesn't solve the issue of the rotational forces and uneven loading on the lower back. My invention, however, does address uneven loading on the load back particularly as the torso angles forward, which has physical therapy and physical rehabilitation setting applications as well. The uneven low-back loading is addressed through my invention because the apparatus allows lateral stability while having both hands free to together hold weight, thereby reducing rotational forces as the torso angles forward and promoting even low-back loading. Furthermore, because a unilateral exercise such as Single-Leg RDL can provide higher relative loading with less weight compared to a Romanian Deadlift (bilateral) exercise, my apparatus assisted version of the Single-Leg RDL would be an excellent option in rehabilitation and/or low-back limitation settings due to a person being able to get evenly distributed higher relative loading without having to use higher absolute weight (as compared to the bilateral RDL).

Furthermore, some of the appeals of the Single-Leg RDL exercise are that it is a close-chained unilateral exercise (as is the case with activities such as sprinting and single leg jumping). By applying the principle of exercise training known as the "Principle of Specificity", which deals with training muscles in a manner specific to the adaptations one is hoping to yield, it greatly supports the effectiveness and appeal of incorporating the Single-Leg RDL (which is a closed-chain unilateral exercise) into strength-training and athletic performance programs. By addressing the shortcomings the non-apparatus assisted version of the exercise has (i.e. inducing of misalignment, uneven low back loading, and requiring significant balance and anatomical/technique considerations) my invention will facilitate programming/participation of the namesake exercise.

Applicable Cooperative Patent Classifications include:

A63B:

A63B 17/02; A63B 21/00047; A63B 21/00181; A63B 21/0125; A63B 21/015; A63B 21/0407; A63B 21/0414; A63B 21/0608; A63B 21/1681; A63B 21/4009; A63B 21/4023; A63B 21/4039; A63B 21/4043; A63B 21/4045; A63B 22/001; A63B 22/0025; A63B 2022/0043; A63B 22/0046; A63B 22/0048; A63B 22/0061; A63B 2022/0051; A63B 22/0087; A63B 2022/0092; A63B 2022/0094; A63B 23/0216; A63B 23/0222; A63B 23/0233; A63B 23/03516; A63B 23/03591; A63B 23/04; A63B 23/0482; A63B 2213/00; A63B 2214/00; A63B 69/0028

A61H:

A61H 2001/0207; A61H 3/008; A61H 2201/018; A61H 2201/0173; A61H 2201/1626; A61H 2201/1628; A61H 2205/08; A61H 2205/086; A61H 2205/088; A61H 2205/10; A61H 2205/108

BRIEF SUMMARY OF THE INVENTION

The Single-Leg Romanian Deadlift (Single-Leg RDL) machine invention is an exercise training apparatus which allows a person to carry out the Single-Leg Romanian Deadlift (Single-Leg RDL) exercise with enhanced hip stability in the frontal plane as well as enhanced stability of the "exercise target leg" along the sagittal plane. The user of the apparatus simply sets the anterior waist supporting pad to their appropriate waist height, sets the lower leg supporting pad(s) to the appropriate lower limb heights, places their exercise target using the supporting pad(s) to anchor that leg, and places that same side's anterior pelvis/waist area pressed against the anterior waist supporting pad. On the side opposite of the exercise weight bearing leg, the user will set the vertical portion of the sturdy frame to the height of the hip/ilium and will position their hip/pelvic region so that it ends up pressed against the apparatus hip stabilizing piece that's adjoined to the end of the width-adjusting cantilever. Due to the hip stabilizing piece including a pivot joint structure that adjoins it to the end of the width-adjusting cantilever, while the users hip/pelvic region is pressed against the apparatus hip stabilizing piece (to negate lateral forces and alignment compensations), the pivot joint's rotating function will allow for the hip stabilizing piece to rotate along the sagittal plane so as to follow the changing angle of the user's hip (on the non-weight bearing side) as the user carries out the Single-Leg RDL movement.

The rationale behind the creation and use of this training apparatus is that it enables people to have beneficial musculoskeletal lateral stabilization (at the waist/pelvic region) while leaving the hips and torso free enough for a person to still be able to move through the range of motion involved in the Single-Leg RDL exercise. By having the lateral stabilization provided by the Single-Leg RDL apparatus and having the weight bearing leg anchored to provide sagittal plane stability, it allows one to isolate the exercise target muscles without having to have undesired lateral and rotational forces as well as it allows for optimal recruitment of the exercise targeted hip extensor muscles, respectively.

My Single-Leg RDL apparatus invention solves the previously existing problem of undesired lateral forces (i.e. frontal plane forces creating misalignment of knee and pelvis) and undesired rotational forces (i.e. transverse plane forces that induce asymmetrical low back physical demands), both of which can cause uncomfortable and potentially injurious forces on unintended musculoskeletal structures which otherwise inevitably occurs during the Single-Leg RDL exercise. As it relates to that problem, my invention provides lateral stability and anchoring of the target leg. Additionally, my invention solves another common shortcoming of the Single Leg RDL exercise which is that it requires considerable technical and anatomical position considerations in order to more effectively recruit the intended muscle groups particularly during the eccentric phase. Regarding this, my invention provides the anchoring of the weight bearing leg which gives sagittal plane stability and allows the user to get more optimal recruitment of the exercise target hip extensor muscles with far less technical and anatomical position considerations. Lastly, because of innovative alignment improvements and enhanced stabilizing along the frontal and transverse plane while being able to maintain both arms and hands free, collectively this allows the user the beneficial option to load the exercise with heavier weight, due to that load being much more evenly distributed on the low back muscles and due to having both hands available to hold heavier weight.

DETAILED DESCRIPTION OF THE INVENTION

Figure 1A:
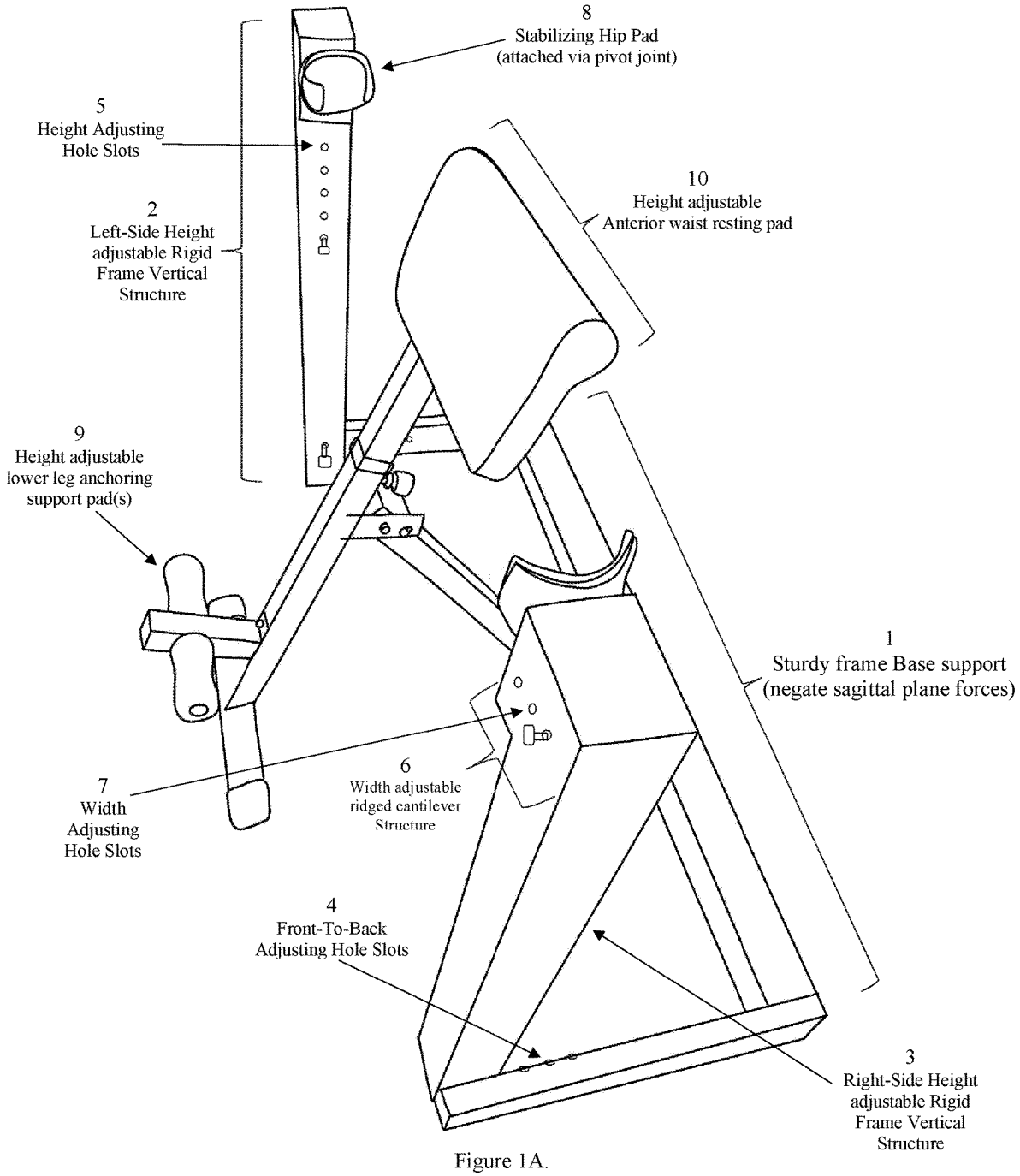
FIG. 1A. depicting an aerial diagonal view of apparatus
Figure 1B:
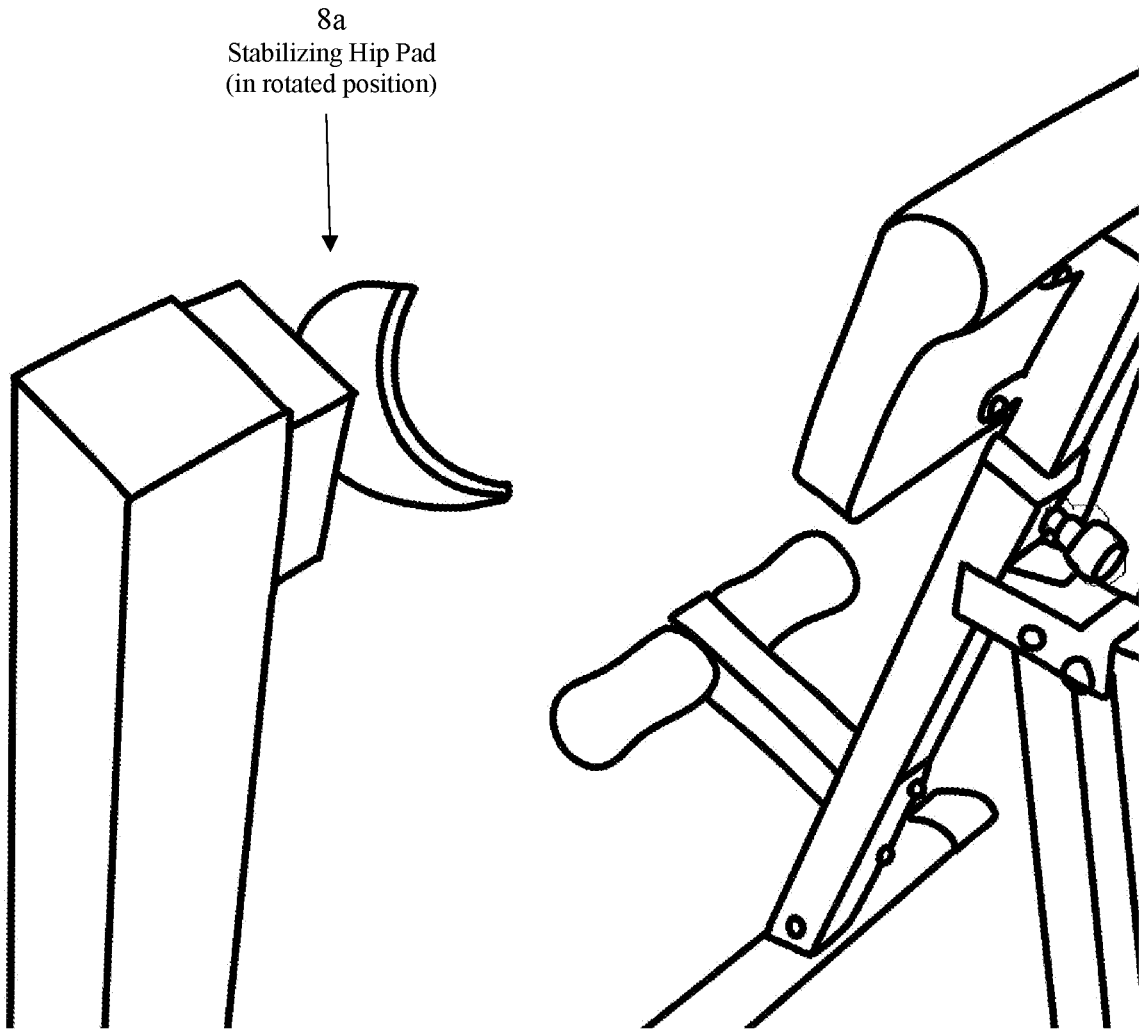
FIG. 1B. depicting a zoomed in view of the apparatus hip pad in a rotated position FIG. 1C. depicting a user using apparatus to do a body-weight Single-Leg RDL FIG. 1D. depicting a user holding weight in both hands while doing a Single-Leg RDL
Figure 1C:
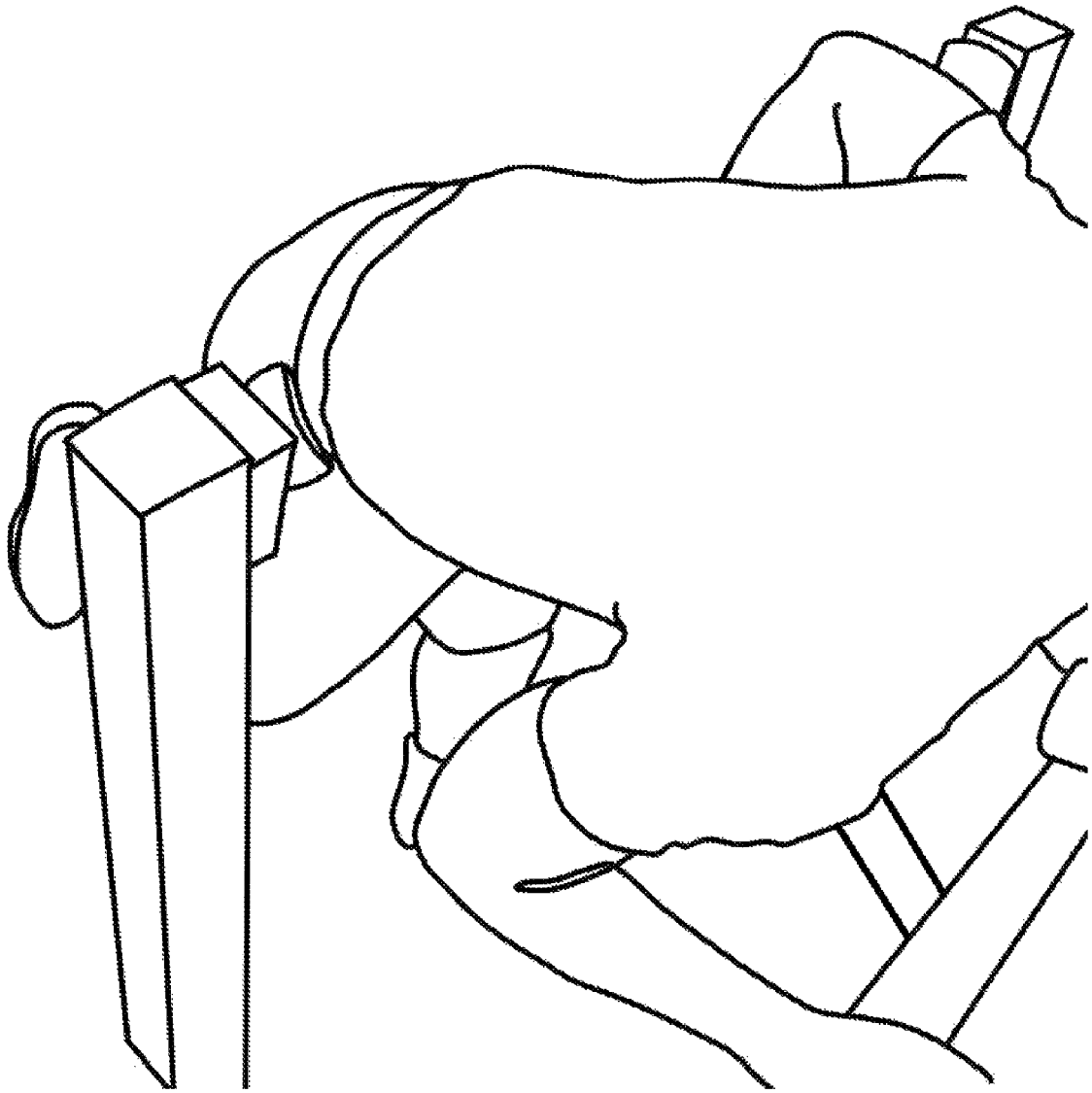
Figure 1D:
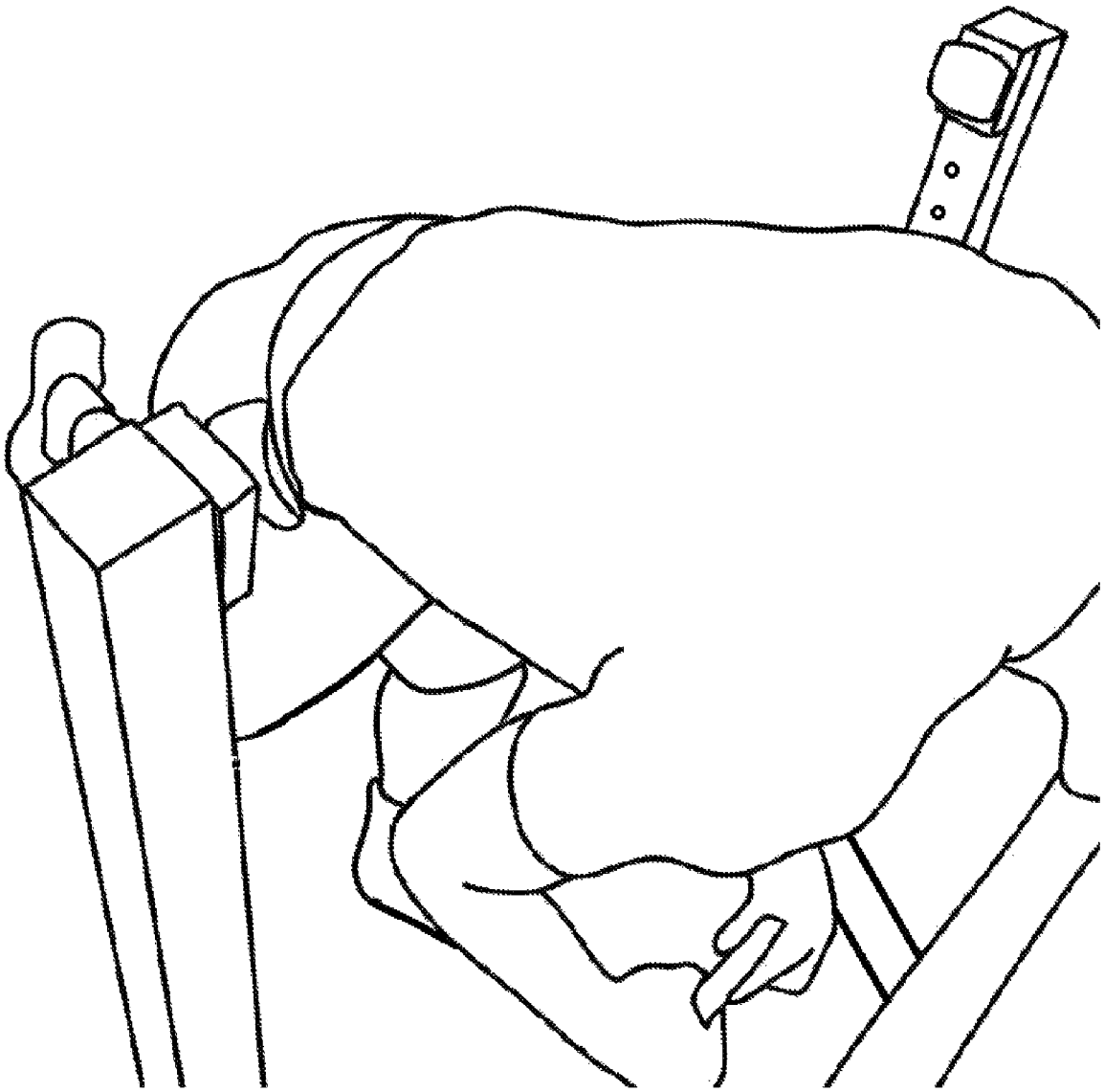

A sturdy frame base that rests on the floor that extends out horizontally along the floor and then back, adjoining into two "upside down 'L'-shaped" rigid vertical structures, as illustrated by FIG. 1A. through FIG. 1D. with one structure being the left-side vertical structure 2 and the other structure being the right-side vertical structure 3. The left and right bodies of the apparatus 2, 3 are firmly adjoined to the floor resting frame base 1. The user will adjust the height adjustable waist resting pad 9 to support their exercise target side's anterior waist area against and will adjust the posterior lower leg anchoring support pad 8 so as to make an anchoring/stabilizing dynamic for the user's exercise target side. The user will then adjust the sagittal plane positioning of the vertical structure opposite the exercise target side by pulling the front-to-back adjustment pin and moving the vertical structure front or back and resetting the pin to lock the vertical structure to the appropriate front-back position hole slot 4. Next the hip opposite the user's exercise target side will be pressed against the padded hip stabilizing piece 8. The user will be able to leverage some of their weight laterally onto the hip stabilizing pad 8 so as to stabilize their pelvis laterally without needing to have compensatory shifts/movements at the knee. The user will then be able to carry out a Single-Leg RDL movement with precise enhanced stability and alignment throughout the exercise movement as shown in FIG. 1C. Furthermore, as shown in FIG. 1D. because the user will accomplish this while having both hands and arms free this will enable the option of adding weight that can be held with both hands thereby distributing the load evenly on the low back as the torso angles forward during the exercise.

The frame of the entire apparatus is made of rigid strong material and is shaped such that as the frame base sits on the floor, the entire apparatus will be able to sturdily support front-to-back (i.e. sagittal plane) forces without tipping over from the user carrying out the exercise (i.e. similar to how a "Low-Back Roman Chair" machine's frame does). The apparatus will have an anterior waist resting pad which will be used to anteriorly support the user's waist on the exercise target side as the user carries out the exercise movement. There will also be lower leg supporting pad(s) which function to anchoring of the user's exercise target leg and allow for the user to get optimal eccentric phase movement and not have to rely as much on technique and balance in order to not fall forward. The anterior waist resting pad as well as the lower leg supporting pad(s), will have height adjusting features so as to accommodate different user waist heights and different femoral and tibial lengths. Additionally, the apparatus is shaped such that the frame base continues out to the sides and has an adjoining height adjustable vertical portion of the sturdy frame which will end up supporting lateral/frontal plane forces produced by some of the user's weight being laterally distributed onto the machine for stability (on the side opposite of the exercise weight bearing leg). More specifically, it is the user's hip on the side opposite of the exercise weight bearing leg, which serves as the point of contact where the user will have their hip/pelvic region pressed against the apparatus hip stabilizing piece, negating the lateral forces and alignment compensations the user would otherwise take on in order to carry out a Single-Leg RDL. The hip stabilizing piece will be attached to the vertical portion of the apparatus frame in such a manner that it will be able to rotate along the sagittal plane so as to follow the changing angle of the user's hip (on the non-weight bearing side) as the user carries out the Single-Leg RDL movement. The hip stabilizing piece's rotation function is accomplished by way of a pivoting joint structure located on the backside of the hip stabilizing piece. The entire hip stabilizing piece-pivot joint structure will be adjoined to a horizontal cantilever which is adjoined to a vertical portion of the apparatus. Therefore in total, the vertical portion of the apparatus will be adjustable by way of pin-locking front-to-back and height adjusting segments to be able to accommodate for different user waist circumferences and hip heights.

The invention claimed is:

1. A muscle-strength training apparatus comprising:

a rigid framed base structure configured to sit on a floor that supports sagittal plane forces without tipping over from a user carrying out a single-leg Romanian deadlift exercise;

the apparatus having an anterior waist resting pad that is adjoined to the rigid frame base structure;

the anterior waist resting pad configured to anteriorly support a user's waist on an exercise target side of the user as the user carries out the single-leg Romanian deadlift exercise;

the anterior waist resting pad having a segment with a lower leg supporting pad(s) adjoined below;

the lower leg supporting pad(s) configured to anchor the user's exercise target leg;

the anterior waist resting pad and the lower leg supporting pad(s) configured to be vertically adjustable for different heights;

the rigid frame base structure having a horizontal shape that extends backwards adjoining into a left and right rigid vertical structure, respectfully;

each rigid vertical structure of the left and right rigid vertical structures having a horizontal portion cantilevered to the respective vertical structure;

each rigid vertical structure having segments configured to be adjusted for front-to-back adjustment and vertical adjustment of the horizontal cantilever portion to allow for aligning an end of the horizontal cantilever portion with the user's exercise non-target side hip;

the end of the horizontal cantilevered portion configured to have a cushioned hip pressing segment adjoined thereon;

the end of the horizontal cantilevered portion with the cushioned hip pressing segment configured to provide lateral stability to an exercise non-target hip/ilium region of the user;

the cushioned hip pressing segment connected to the end of the horizontal cantilevered portion by way of a pivot swivel piece affixed to the end of the horizontal cantilevered portion; and the cushioned hip pressing piece adjoined by the pivot swivel piece configured to rotate along the sagittal plane following a changing angle of the user's hip/ilium as the user carries out the single-leg Romanian deadlift exercise.

* * * * *